United States Patent [19]

Eckhardt

[11] Patent Number: 4,480,937

[45] Date of Patent: Nov. 6, 1984

[54] BREAKAWAY LEAFSPRING ACTUATED KEYSWITCH APPARATUS

[76] Inventor: Richard A. Eckhardt, 51 Lockeland Ave., Arlington, Mass. 02174

[21] Appl. No.: 412,986

[22] Filed: Aug. 30, 1982

[51] Int. Cl.[3] ..... B41J 5/08; H01H 21/04; H01H 3/12

[52] U.S. Cl. ..... 400/479; 400/491.2; 200/67 D; 200/67 DA; 200/5 R; 200/159 A

[58] Field of Search ..... 400/480, 481, 491, 491.2, 400/491.3, 495; 200/67 DA, 153 L, 153 LA, 159 R, 5 R, 67 D, 159 A

[56] References Cited

U.S. PATENT DOCUMENTS

| | | | |
|---|---|---|---|
| 1,215,665 | 2/1917 | Landis | 200/67 DB |
| 3,800,104 | 3/1974 | Lien et al. | 200/159 A X |
| 4,278,855 | 7/1981 | Rossi | 200/67 D |
| 4,341,934 | 7/1982 | Muller | 200/159 R X |
| 4,363,942 | 12/1982 | Deeg et al. | 400/495 X |
| 4,386,240 | 5/1983 | Philipp et al. | 200/5 R |
| 4,394,553 | 7/1983 | Feil | 200/67 DA |

*Primary Examiner*—Paul T. Sewell
*Assistant Examiner*—David A. Wiecking
*Attorney, Agent, or Firm*—Jerry Cohen

[57] ABSTRACT

A keyswitch apparatus for electronic typewriter keyboards and the like including a circuit board having at least one pair of electrical conductors, each conductor having contact means, at least one single-piece spring and contact system, each including a frame portion adapted for directly mounting to the circuit board and at least one spring and contact unit. Each spring and contact unit is associated with an associated pair of circuit board conductors, maintains direct electrical contact with the contact means of a first one of the conductors of the pair and includes a base section connected to the frame portion and bent into a longitudinal channel form, a leaf spring member cantilevered upwardly from the base section and having flat spring means urging the first extension section upwardly relative to the static board, and a contact member cantilevered downwardly from the base section for providing direct electrical contact with the contact means of the second one of the conductors of the pair when a preestablished downward force is exerted on the cantilevered end of the leaf spring member. The base and leaf spring member urge the second extension section apart from the contact means of the second static board conductor of the pair. There are means for depressing the cantilevered end of the first extension section to straighten the channel of the base section and thereby lower the second extension section to make direct electrical contact with the contact means of the second static board conductor of the pair.

13 Claims, 17 Drawing Figures

BREAKAWAY LEAFSPRING ACTUATED KEYSWITCH APPARATUS

BACKGROUND OF THE INVENTION

This invention relates to a keyswitch apparatus for use in electronic typewriter keyboards, computers, terminals, calculators, cash registers and controls for electronic equipment and the like.

Keyswitch units for device keyboards and the like typically utilize a substantial number of individual pieces. For example, each such unit may require a spring, one or more switching contacts, a plunger, a keycap and a housing within which the unit is fitted. These elements must be assembled onto a PC board. Such assemblage is often tedious and time consuming. Each switch must be loaded individually into the board and a large number of holes or attachment points must be provided. Soldering of the various elements is oftentimes required. Extensive soldering is inconvenient and cleaning thereafter must be performed very carefully to insure that cleaning solvent does not come in contact with the switch contacts.

In short, the relatively large number of individual keyswitch parts contributes greatly to time difficulty and expense in assembling the device and thus to the overall cost of the keyboard.

It is therefore an object of this invention to provide an improved keyswitch apparatus for electronic typewriter keyboards and the like which uses few individual parts and may be quickly, simply and inexpensively assembled.

It is a further object of this invention to provide a keyswitch apparatus for electronic typewriter keyboards and the like which exhibits consistent and satisfactory typing feel and which operates dependably over repeated use.

It is a further object of this invention to provide a keyswitch apparatus for electronic typewriter keyboards and the like which may be incorporated readily into existing typewriter keyboards and the like.

SUMMARY OF THE INVENTION

The invention features a keyswitch apparatus for electronic typewriter keyboards and the like including means defining a circuit board having at least one associated pair of electrical conductors. Each such conductor includes contact means. These are means defining at least one single piece spring and contact system. Each such system includes a frame portion adapted for mounting to the circuit board and at least one spring and contact unit. Each such unit is associated with an associated pair of static board conductors and maintains fixed electrical contact with the contact means of one of the conductors of the pair. Each spring and contact unit includes a base section connected to the frame portion and (optionally) bent into a longitudinal channel form, a leaf spring member cantilevered upwardly from the base section and having flat spring means urging the first extension section upwardly relative to the static board, and a contact member cantilevered downwardly from the base section means of the second one of the conductors of the associated pair when a pre-established downward force is exerted on the cantilevered end of the leaf spring member. The base section and the leaf spring member urge the contact member apart from the electrical contact means of the second circuit board conductor of the associated pair. There are means for depressing the cantilevered end of the leaf spring member to straighten the channel of the base section and thereby lower the contact member to make direct electrical contact with the contact means of the second circuit board conductor of the associated pair.

Each spring and contact unit is typically associated with one key of the keyboard, i.e., depressing a spring to make electrical contact indicates that a key corresponding to a particular letter, number or other indicia has been selected.

Typically the spring and contact system will be constructed of a thin (approximately 0.004 inch) strip of beryllium, copper or similar electrically conductive metal. The system will be spring tempered and will preferably include anywhere from four to twenty spring and contact units. Each such unit is integrally connected to the frame. The leaf spring member may include a triangular plate spring or any other acceptable spring means for providing the normal return spring force to each unit in the apparatus. The base section channel is typically of a V- or U-shaped cross section. The base thus acts as a very stiff spring until sufficient force is applied to "pop" the channel into its flat, straightened state. This serves to lengthen the spring lever arm and substantially decrease the spring constant, causing the base section to "break away" when the pre-established downward force is applied.

It is preferred that multiples of the contact member and circuit board contacts be provided spanning the leaf spring member of each spring and contact unit. The contact members may comprise bifurcated contacts which are preferably gold plated.

These contacts can be plated by continuous strip processing. The metallic strip (i.e., the spring and contact system) may be run down a rail which depresses the springs down to the level of the frame portion. The contacts of the contact members consequently protrude below the frame and can be dipped into plating fixtures.

The circuit board is typically a PC board and the contact means thereof are typically metal traces which may be selectively plated using standard PC processing methods.

Preferably a one piece support is attachable to the static board and superposable over the frame portion of each spring and contact strip. The static board is secured to the support with staked pins, drive screws or other comparable fasteners. When such a support is included the means for depressing may include a plunger. In such embodiments, guide means are integrally connected to the support for guiding, depressing and retraction of the plunger. The bottom end of each plunger is designed to engage and depress the cantilevered end of one of the spring and contact unit's leaf spring members. The top end is designed for applying the depressing force directly thereto or alternatively for fitting a keycap thereon. The plunger includes stop means proximate the bottom end thereof for engaging the guide means and restricting retraction of the plunger.

In an alternative embodiment of this invention, the key cap may be made integral with the plunger. In such an embodiment, a retaining barb may be carried proximate the bottom end of the plunger portion. Complementary retaining means are integrally connected to either the guide means or the support. The barb element is contoured for allowing insertion of the plunger downwardly through the guide means and/or the support but for restrictively engaging the retaining means when the plunger is retracted upwardly.

In addition to use in typewriter keyboards, the apparatus of this invention is suitable for use in calculators, terminals, word processors, personal computers and similar devices. Providing a one piece support and continuous "strips" of one piece spring and contact units greatly reduces the number of parts required and thus the time and expense of producing the keyboard. Such savings are enhanced because the soldering, and therefore cleaning, of switches is eliminated.

As a comparison, a 64 key prior art keyboard will typically include a plastic housing, 64 plungers, 64 springs and 128 contacts; a total of 257 individual parts which must be assembled. The resultant keyboard must still be fastened and soldered to a PC board. A 64 key keyboard according to this invention has a one piece molded support, 64 plungers, 8 spring and contact system strips (each including 8 integral spring and contact units) and a PC board; a total of 74 parts including the PC board.

Other objects, features and advantages of the invention will be apparent from the following description of preferred embodiments with reference therein to the accompanying drawing in which:

DETAILED DESCRIPTION OF PREFERRED EMBODIMENTS

Figure 1:
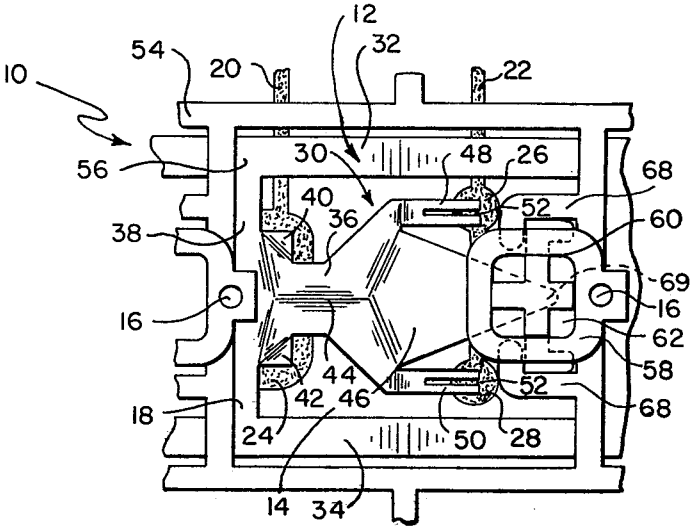
FIG. 1 is a top cross-sectional view of the keyswitch apparatus according to a first preferred embodiment of the invention.
Figure 2:
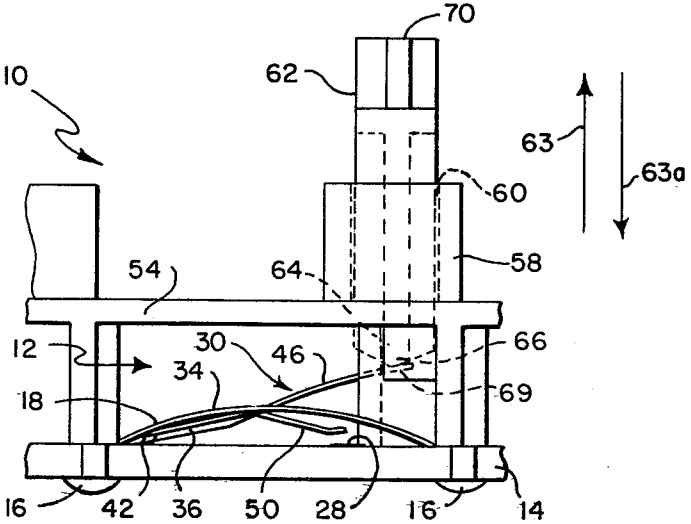
FIG. 2 is a side cross-sectional view of the keyswitch apparatus of this invention.
Figure 4:
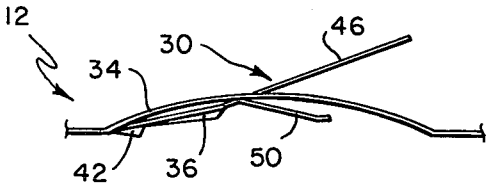
FIG. 4 is an elevated side view of the spring and contact system.
Figure 3:
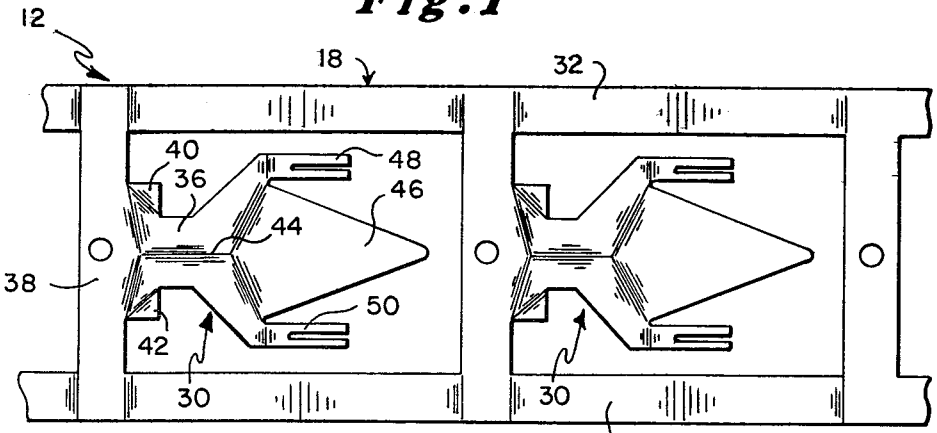
FIG. 3 is a top view of a spring and contact system used in the keyswitch apparatus of a first preferred embodiment of this invention.

There is shown in FIGS. 1 and 2 a keyswitch apparatus 10 for use in electronic typewriter keyboards and the like. A spring and contact system 12, illustrated alone in FIGS. 3 and 4, is laid over and mounted to a circuit board such as PC board 14. The mounting is done by means of heat sealed mounting pins 16. Such heat sealed pins are part of the housing. Screws may be used instead. These would be inserted from the bottom and extend through frame portion 18 of system 12. PC board 14 includes electrical conductors 20,22. Conductor 22 includes contact means 26, 28. Typically the contact means include metal traces which can be designed with only one or multiple contacts.

As shown in FIG. 3 spring and contact system 12 typically comprise a one-piece metal strip including frame portion 18 and a number of spring and contact units 30 integrally interconnected to portion 18. As shown more clearly in FIG. 2 longitudinal elements 32, 34 of frame portion 18 are bowed upwardly from board 14 to avoid contact with the conductors 20, 22 and the short circuiting which may result therefrom. This permits use of a single side of PC board 14. Each spring and contact unit 30 is associated with a pair of PC board conductors, such as 20, 22 of FIG. 1. All of the fixed contacts in a contact strip are connected together. A separate conductor connecting to it for each switch is not necessary. Additionally, a number of spring and contact systems 12 may be included, each in the form of a one-piece strip, as in FIG. 3, and including a number of spring and contact units 30. Each unit 30 corresponds to one key of the keyboard. The following description of a single spring and contact unit 30 applies to each such unit in the apparatus.

Base section 36 is integrally connected to cross strap 38 of frame 18 and carries contacts 40, 42 which make fixed electrical contact with contact means 24 of conductor 20, FIG. 1. Base 36 is bent into a longitudinal channel 44 and thereby forms a breakaway of cricket spring biased into the channel form. A first extension section comprising a flat triangular plate spring 46 is cantilevered upwardly from base 36, as most clearly indicated in FIGS. 2 and 4. The spring means in plate spring 46 biases spring 46 upwardly from board 14. Contacts 48, 50 extend from base 36 on either side of plate spring 46 and each includes longitudinal slot 52 (which is preferred for increased reliability). As indicated in FIGS. 2 and 4 contacts 48, 50 are cantilevered downwardly and as shown in FIG. 1 these contacts are lined up with metal trace contacts 26, 28 of PC board conductor 22. However, FIG. 2 shows that this upward bias of the cricket spring in base 36 and the plate spring 46 urges contacts 48 and 50 apart from PC board contacts 26 and 28.

Figure 6:
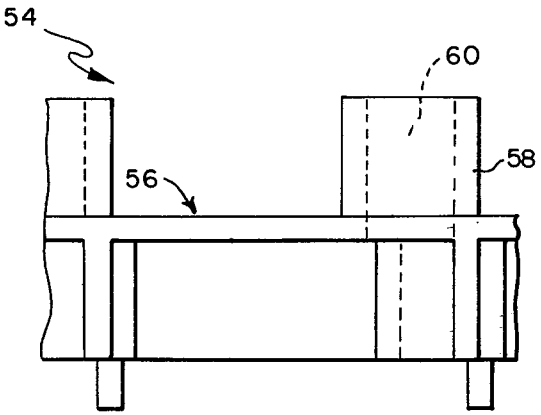
FIG. 6 is an elevated side cross-sectional view of the support.
Figure 5:
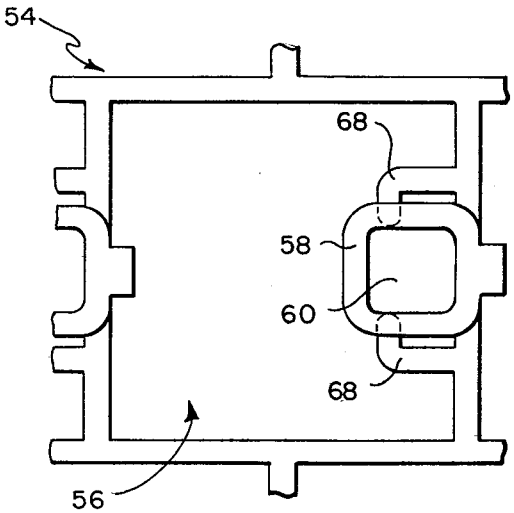
FIG. 5 is a top cross-sectional view of the support used in the keyswitch apparatus.
Figure 8:
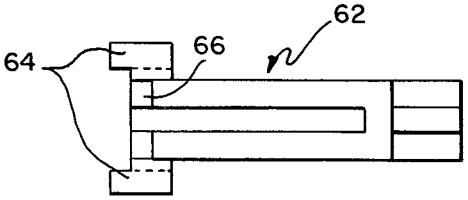
FIG. 8 is an elevated front view of the plunger.
Figure 7:
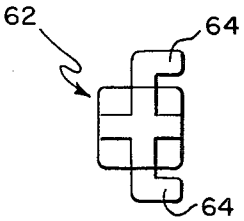
FIG. 7 is a top view of the plunger used in the keyswitch apparatus of this invention.
Figure 9:
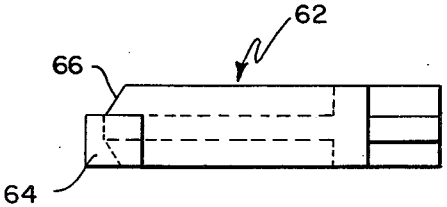
FIG. 9 is an elevated side view of the plunger

A support 54, shown separately in FIGS. 5 and 6, is molded as a single unit for the entire keyboard, i.e., it accommodates each spring and contact system 12 and spring and contact unit 30 in the apparatus. In FIGS. 1, 2 support 54 is superposed over frame portion 18 and is mounted to PC board 14 by the mounting pins 16. As FIG. 1 illustrates support 54 forms a series of cells 56, each enclosing a spring and contact unit 30. As shown in FIGS. 1, 2, 5, 6 each such cell 56 of support 54 includes a plunger guide 58 having a channel 60 for receiving a plunger 62. Plunger 62, shown alone in FIGS. 7–9, is movable in an up and down manner in the direction of arrows 63, 63A, FIG. 2, through channel 60 of guide 58 and includes stop elements 64 extending from either side thereof and proximate the bottom end 66 thereof. As shown in FIGS. 1 and 2 stop elements 64 interfere with the bottom of guide 58 to restrict upward movement of plunger 62. Guide arms 68 extending from support 54 fit closely over stop elements 64 to assist the guiding plunger 62 and insuring smooth movement thereof.

Apparatus 10 is assembled to the state shown in FIGS. 1 and 2. Each plunger 62 (one being associated with each spring and contact unit 30) is inserted upwardly through a guide 58 connected to support 54. Contact strips are placed on the PC board mounting pins 16 from the bottom. Finally PC board 14 is mounted to support 54.

In operation plunger 62 is depressed in the direction of arrow 63A, FIG. 2, so that its bottom end 66 bears against the cantilevered end 79 of plate spring 46. When a pre-established force is reached the breakaway spring of base 36 buckles and base 36 straightens. The cricket-like sound such as that produced by the bottom of an oil can is produced. The contacts 48, 50 carried by base 36 are consequently lowered to make direct electrical contact with metal trace contacts 26 and 28. Electrical contact and conduction is thus established between conductors 20 and 22 of PC board 14 and a signal indicating that a particular keyswitch has been closed is sent. Although not disclosed in FIGS. 1 and 2 it is readily apparent that a standard keycap may be fitted to the top end 70 of plunger 62.

When downward pressure on plunger 62 is released plate spring 46 and the breakaway spring of base 36 urge unit 30 upwardly and contacts 48 and 50 apart from PC board contacts 26 and 28, thereby breaking electrical contact. Plunger 62 is likewise urged upwardly but due to the interference between guide 58 and stop elements 64 the plunger will not pop out of the guide 58 and support 54.

In an alternative embodiment, shown in FIGS. 10–16, an integral plunger-keycap member 80 may be used. Cap portion 81 is integral with plunger portion 83. A spring and contact unit 30 identical to that used in FIGS. 1–4 is utilized (and cnsequently like numbers are provided in FIGS. 10 and 11).

Figure 11:
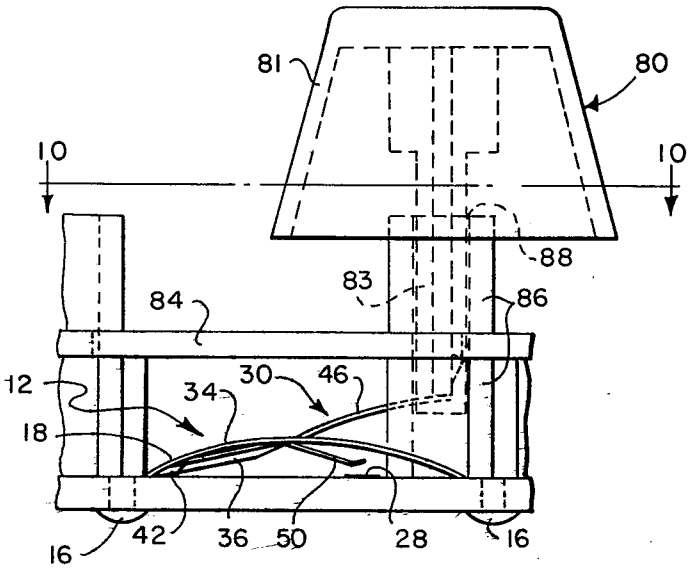
FIG. 11 is an elevated side cross-sectional view of the keyswitch apparatus of FIG. 10.
Figure 13:
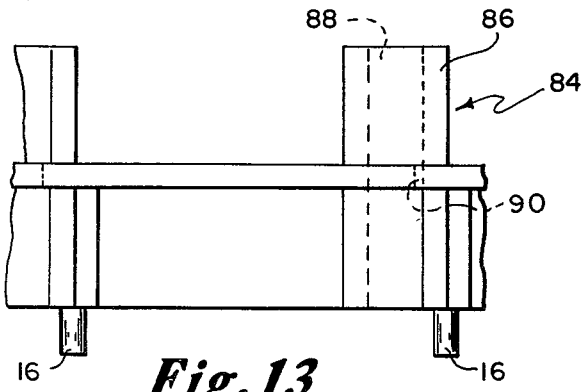
FIG. 13 is an elevated side cross-sectional view of the support of FIG. 12.
Figure 10:
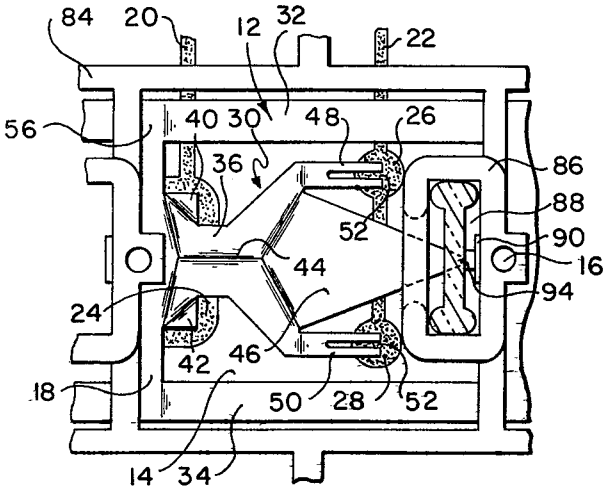
FIG. 10 is a top cross-sectional view of an alternative preferred embodiment of a keyswitch apparatus according to this invention taken along line 10—10 of FIG. 11.
Figure 12:
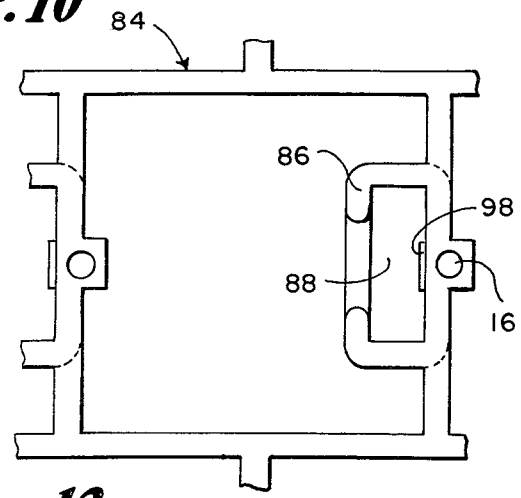
FIG. 12 is a top view of the support used in the keyswitch apparatus of FIG. 10.
Figure 15:
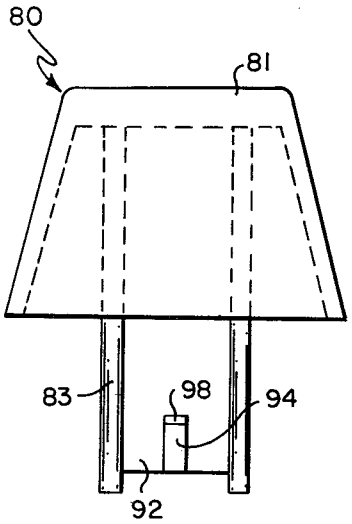
FIG. 15 is an elevated front cross-sectional view of the unitary keycap plunger of FIG. 14.
Figure 14:
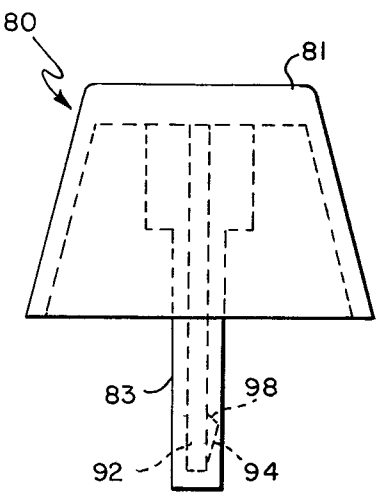
FIG. 14 is an elevated side cross-sectional view of the unitary keycap plunger member used in the keyswitch apparatus of FIGS. 10 and 11.
Figure 16:
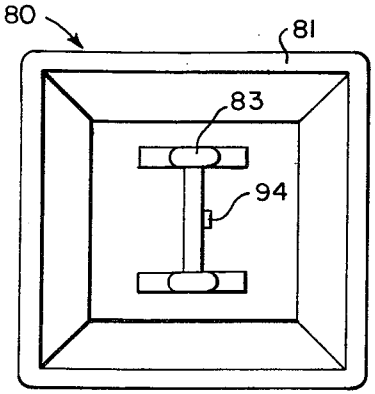
FIG. 16 is a top view of the unitary keycap plunger of FIG. 14.

Support 84 including a guide 86, FIGS. 10–13, which has a channel 88 and retaining member 90 in the wall of channel 88. The support 84, guide 86 and retaining member 90 comprise a one-piece element. A single piece plunger-keycap member 80, FIGS. 14–16, is provided. At the bottom end 92 of member 80 is an integral retaining barb 94. As shown in FIGS. 10 and 11 plunger portion 83 of member 80 is inserted downwardly through channel 88 of guide 86. The angled contour of barb element 94 enables it to slide downwardly past retaining member 90. However, the substantially horizontal upper surface 98 of barb 94 interfaces with retaining member 90 when unitary member 80 is retracted upwardly and thus upward removal of the plunger portion 83 from channel 88 of guide 86 is restricted. By contouring upper surface 98 of barb 94 on a slightly downward angle upward removal may be obtained by pulling member 80 upwardly (although unintended "popping out" of the member 80 will still be prevented). Operation of this embodiment occurs as described for the separate keycap plunger embodiment of this invention.

Figure 17:
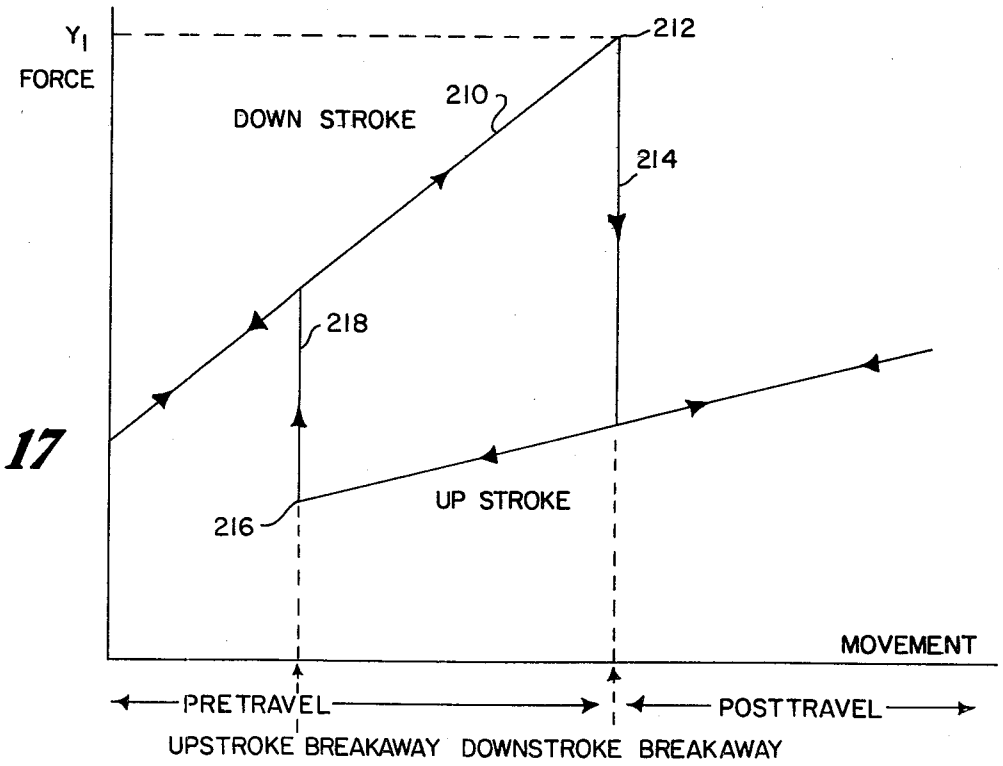
FIG. 17 is a diagram illustrating the force versus movement relationship exhibited when the spring and contact unit of this invention is depressed.

FIG. 17 illustrates the force versus displacement relationship of a spring and contact unit 30 (refer simultaneously to FIGS. 1 and 2). During the down stroke, downward force $Y_1$ on the unit 30 is increased and plate spring 46 moves downwardly as indicated along line 210. During this period there is little or no movement of contacts 48 and 50. At point 212 the channel in base 36 straightens; downstroke breakaway occurs. The spring resistance of plate spring 46 (and thus the $Y_1$ force) precipitously drops as indicated in FIG. 17 by line 214. Contacts 48, 50 lower to make electrical contact with the PC board traces. Following this breakaway there follows a period of post travel during which plate spring 46 continues in a downward direction and then reverses to an upward direction during the upstroke. Contacts 48, 50 remain in contact with the PC board traces. When spring 46 returns to a point 216, base section 36 snaps back into bent-channel form. This represents the upstroke breakaway line 218, during which there is a great increase in the spring resistance. Contacts 48, 50 are separated from the PC board traces. Finally the spring and contact unit 30 returns to its initial position where it is set to commence another force and displacement cycle.

It is evident that those skilled in the art, once given the benefit of the foregoing disclosure, may now make numerous other uses and modifications of, and departures from, the specific embodiments described herein without departing from the inventive concepts. Consequently, the invention is to be construed as embracing each and every novel feature and novel combination of features present in, or possessed by, the apparatus and techniques herein disclosed and limited solely by the spirit and scope of the appended claims.

What is claimed is:

1. Keyswitch apparatus for electronic typewriter keyboards and the like comprising, means defining a circuit board having at least one associated pair of electrical conductors, each conductor having contact means, means defining at least one spring and contact system, each including a frame portion adapted for directly mounting to said circuit board and at least one spring and contact unit, each unit being associated with an associated pair of circuit board, conductors, maintaining fixed electrical contact with the contact means of a first one of said conductors of the pair, and including a base section which includes breakaway spring means connected to said frame portion, a leaf spring member cantilevered upwardly from said base section and a contact member cantilevered downwardly from said base section for providing direct electrical contact with said contact means of the second one of the conductors of the pair when a pre-established downward force is exerted on the cantilevered end of the leaf spring member, said base section and said leaf spring member urging said contact member apart from said contact means of the second circuit board conductor of the pair, and means for depressing the cantilevered end of said leaf spring member to snap said base section and thereby lower said contact member to make direct electrical contact with said contact means of the second circuit board conductor of the pair, the apparatus being constructed and arranged to afford different force-displacement characteristics on leaf spring member cantilevered end upstrokes and down-strokes, the latter including a sharp break-away zone.

2. The apparatus of claim 1 wherein multiples of said contact members and circuit board contacts are provided spanning said leaf spring member of each spring and contact unit.

3. The apparatus of claim 1 further including means defining a support which is attachable to said circuit board and superposable over said frame portion of each spring and contact system.

4. The apparatus of claim 3 wherein said means for depressing include a plunger and wherein said apparatus further includes guide means integrally connected to said support for guiding upward and downward movement of said plunger.

5. The apparatus of claim 4 wherein said plunger includes stop means proximate the bottom end thereof for engaging said guide means and restricting retraction of said plunger.

6. The apparatus of claim 4 wherein said means for depressing further include a keycap fittable on the top end of said plunger for applying downward pressure thereto.

7. The apparatus of claim 6 wherein said keycap and plunger comprise a unitary member.

8. The apparatus of claim 7 further including retaining means integral with said guide means and wherein said unitary member includes a retaining barb proximate the bottom end of said plunger, said retaining barb being tapered for allowing insertion of said plunger downwardly through said guide means and including a top edge for restrictively engaging said retaining means when said unitary member is retracted thereby restricting upward movement of said unitary member.

9. The apparatus of claim 7 further including retaining means integrally connected to said support and wherein said unitary member includes a retaining barb proximate the bottom end of said plunger, said barb being tapered for allowing insertion of said plunger downwardly through said support and including a top edge for restrictively engaging said retaining means when said unitary member is retracted, thereby restricting upward movement of said unitary member.

10. The apparatus of claim 1 wherein said static board contact means include metal traces.

11. The apparatus of claim 1 wherein said frame includes a pair of longitudinal elements associated with and spaced from each spring and contact unit, said longitudinal elements being bowed upwardly from said circuit board.

12. The apparatus of claim 1 wherein said base section is bent into a longitudinal channel form, said channel extending generally from said frame to said leaf spring member.

13. The apparatus of claim 12 wherein said base section channel is V-shaped.

* * * * *